US007274144B2

(12) United States Patent
Choi et al.

(10) Patent No.: US 7,274,144 B2
(45) Date of Patent: Sep. 25, 2007

(54) PLASMA DISPLAY PANEL PROVIDED WITH ELECTRODE PAIRS BORDERING EACH SIDEWALL OF BARRIER RIBS MEMBERS

(75) Inventors: Hoon-Young Choi, Suwon-si (KR); Min Hur, Suwon-si (KR)

(73) Assignee: Samsung SDI Co., Ltd, Suwon-si (KR)

( * ) Notice: Subject to any disclaimer, the term of this patent is extended or adjusted under 35 U.S.C. 154(b) by 0 days.

(21) Appl. No.: 11/243,718

(22) Filed: Oct. 4, 2005

(65) Prior Publication Data

US 2006/0082307 A1 Apr. 20, 2006

(30) Foreign Application Priority Data

Oct. 19, 2004 (KR) ..... 10-2004-0083463

(51) Int. Cl.
*H01J 17/49* (2006.01)

(52) U.S. Cl. ..... 313/582; 313/583; 313/586; 313/585

(58) Field of Classification Search ..... 313/582–587, 313/610; 349/32, 84
See application file for complete search history.

(56) References Cited

U.S. PATENT DOCUMENTS

| | | | | |
|---|---|---|---|---|
| 5,744,909 | A * | 4/1998 | Amano | 313/585 |
| 6,774,562 | B2 * | 8/2004 | Roche et al. | 313/582 |
| 2002/0003405 | A1 * | 1/2002 | Kang | 313/586 |
| 2005/0093447 | A1 * | 5/2005 | Jeon | 313/582 |
| 2005/0110409 | A1 * | 5/2005 | Zeng et al. | 313/582 |
| 2005/0264203 | A1 * | 12/2005 | Hur et al. | 313/583 |
| 2006/0181209 | A1 * | 8/2006 | Kwon et al. | 313/582 |

FOREIGN PATENT DOCUMENTS

| | | |
|---|---|---|
| JP | 2000-294148 | 10/2000 |
| JP | 2000-331613 | 11/2000 |
| KR | 1999-0053751 | 7/1999 |

OTHER PUBLICATIONS

Patent Abstracts of Japan for Publication No. 2000-331613; Date of publication of application Nov. 30, 2000, in the name of Hideo Tanabe et al.
Korean Patent Abstracts for Korean Patent Publication No. 10-0279255; Publication date Jul. 15, 1999, in the name of Sun Mok Yeo.
Patent Abstracts of Japan for Publication No. 2000-294148; Date of publication of application Oct. 20, 2000, in the name of Atsuo Osawa et al.

* cited by examiner

*Primary Examiner*—Mariceli Santiago
(74) *Attorney, Agent, or Firm*—Christie, Parker & Hale, LLP

(57) ABSTRACT

An exemplary PDP according to an embodiment of the present invention includes first and second substrates, an address electrode, first and second barrier ribs, first and second electrodes, and a phosphor layer. The first and second substrates face each other, the address electrode is formed on the first substrate and extends in a first direction, and the first barrier rib is formed on the first substrate and partitions a plurality of first discharge cells. The first and second electrodes extend along the second direction and are disposed in the first discharge cells. The second barrier rib is formed on the second substrate and partitions second discharge cells that correspond to the first discharge cells. The phosphor layer is formed in the discharge cells on the second substrate.

21 Claims, 5 Drawing Sheets

PLASMA DISPLAY PANEL PROVIDED WITH ELECTRODE PAIRS BORDERING EACH SIDEWALL OF BARRIER RIBS MEMBERS

CROSS-REFERENCE TO RELATED APPLICATION

This application claims priority to and the benefit of Korean Patent Application 10-2004-0083463 filed in the Korean Intellectual Property Office on Oct. 19, 2004, the entire content of which is incorporated herein by reference.

BACKGROUND OF THE INVENTION (a) Field of the Invention

The present invention relates to a plasma display panel. More particularly, the present invention relates to an opposing discharge type of plasma display panel having high luminescence efficiency and easier fabrication.

(b) Description of the Related Art

A plasma display panel (hereinafter referred to as a "PDP") is a display device for displaying an image with visible light generated by exciting phosphors with vacuum ultraviolet (VUV) rays radiated by plasma during gas discharge. A PDP provides a very wide screen of greater than 60 inches with a thickness of less than 10 cm. Additionally, a PDP has excellent color representation and exhibits no distortion based on viewing angle because a PDP is a self-emissive display device like a cathode ray tube (CRT). Additionally, a PDP has advantages over other display panels in productivity and production cost, since its fabrication method is simple compared to that of a liquid crystal display (LCD). Because of these advantages, a PDP may be more suitable than other displays as a flat panel display for industrial use and a television display for home use in the next generation.

One type of PDP is a three-electrode surface-discharge type PDP. The three-electrode surface-discharge type PDP includes a front substrate and a rear substrate separated by a space, display electrodes on the front substrate, and address electrodes on the rear substrate crossing the display electrodes. Additionally, the front and rear substrates are placed together and a discharge gas is filled in the space between them. An address discharge is generated by individually controlled scan electrodes connected to each line and address electrodes crossing the scan electrodes. A sustain discharge is generated by the scan electrodes and the sustain electrodes facing each other and located on the same surface. Occurrence of a discharge is determined by the address discharge, and brightness is determined by the sustain discharge.

Another type of PDP is a three-electrode opposing discharge type of PDP. A driving method of the opposing discharge type of PDP is similar to that of the surface-discharge type of PDP. In the opposing discharge type of PDP, scan electrodes and sustain electrodes for sustain discharge are disposed facing each other, at opposing sides of discharge cells. Accordingly, a discharge length in the opposing discharge type PDP may be greater than that of the surface-discharge type PDP, and thereby luminescence efficiency may be improved. However, the opposing discharge type of PDP has disadvantages in that the discharge firing voltage is high and the fabrication of the PDP is difficult. In other words, it is difficult to form sustain electrodes and scan electrodes so that they face each other within barrier ribs in a fabrication process of the opposing discharge type of PDP. Additionally, in the case of a high definition PDP, it is more difficult to install sustain electrodes and scan electrodes within fine barrier ribs. Additionally, if the sustain electrodes and the scan electrodes are installed on the barrier ribs, a maximum discharge length is formed in the discharge cells. Accordingly, a high discharge firing voltage is required for sustain discharge in the absence of additional elements.

The above information disclosed in this background section is only for enhancement of understanding of the background of the invention, and therefore it may contain information that does not constitute prior art that is already known to an ordinary person skilled in the art.

SUMMARY OF THE INVENTION

An exemplary embodiment of a plasma display panel (PDP) according to the invention has advantages of high luminescence efficiency and easier fabrication by forming and disposing sustain electrodes and scan electrodes facing each other.

An exemplary PDP according to an embodiment of the present invention includes first and second substrates, an address electrode, first and second barrier ribs, first and second electrodes, and a phosphor layer. The first and second substrates face each other. The address electrode is formed on the first substrate and extends in a first direction. The first barrier rib is formed on the first substrate and partitions a plurality of first discharge cells. The first barrier rib includes first barrier rib members disposed in a second direction crossing the first direction and second barrier rib members disposed in the first direction. The first and second electrodes extend along the second direction and are disposed in the first discharge cells, corresponding to the first barrier rib members. The second barrier rib is formed on the second substrate and partitions second discharge cells that correspond to the first discharge cells. The second barrier rib includes third barrier rib members, corresponding to the first barrier rib members and protruding towards the first substrate, and fourth barrier rib members, corresponding to the second barrier rib members and protruding towards the first substrate. The phosphor layer is formed in the discharge cells on the second substrate. The first and second barrier ribs and the first and second electrodes each have a height measured along a third direction, which is perpendicular to both the first direction and the second direction, and a width measured along the first direction or the second direction.

Outer surfaces of the first electrode and the second electrode can be surrounded by a dielectric layer.

In one embodiment, the heights of the first electrode and the second electrode are less than half of a sum of the heights of the first barrier rib and of the second barrier rib. The heights of the first electrode and the second electrode may be less than or equal to 50 μm. With such a gap between the phosphor layer and the first and second electrodes, deterioration of the phosphor layer may be reduced.

Additionally, the height of the first barrier rib can be less than that of the second barrier rib. The height of the first barrier rib can also be equal to the sum of the height of the first electrode and the height of the dielectric layer surrounding the first electrode. Additionally, the height of the first barrier rib can be equal to a sum of the height of the second electrode and the height of the dielectric layer surrounding the second electrode.

Heights of the first and second electrodes may be greater than the widths thereof. Accordingly, the opposing discharge may become more easily facilitated. The width of the first electrode may be equal to the width of the second electrode, and the height of the first electrode can be equal to the height of the second electrode.

The height of the first electrode may be greater than the width thereof. The width of the second electrode can be greater than the width of the first electrode, and the height of the second electrode can be equal to the height of the first electrode. As the height of the second electrode is increased, a facing area between the second electrode and the address electrode is increased, and thereby address discharge may be generated more easily.

Two surfaces of the first electrode in the first or second directions and two surfaces of the first electrode in the third direction may be surrounded by a dielectric layer. One surface of the second electrode in the first or second direction and two surfaces of the second electrode in the third direction may be surrounded by the dielectric layer.

Additionally, a light-reflecting dielectric layer may be included between the first substrate and the address electrode. The light-reflecting dielectric layer may be formed from a dielectric material in a thin film or paste state. The light-reflecting dielectric layer effectively reflects visible light or vacuum ultraviolet (VUV) rays generated by the discharge cell, thereby improving luminescence efficiency.

The phosphor layer may be formed in inner surfaces of the third barrier rib members and the fourth barrier rib members partitioning the second discharge cells, as well as in the inner surface of the second substrate partitioned by the third barrier rib members and the fourth barrier rib members.

The phosphor layer may be formed with a thickness of less than 10 μm, and thereby a decrease of visible light transmittance may be prevented.

DETAILED DESCRIPTION

Figure 1:
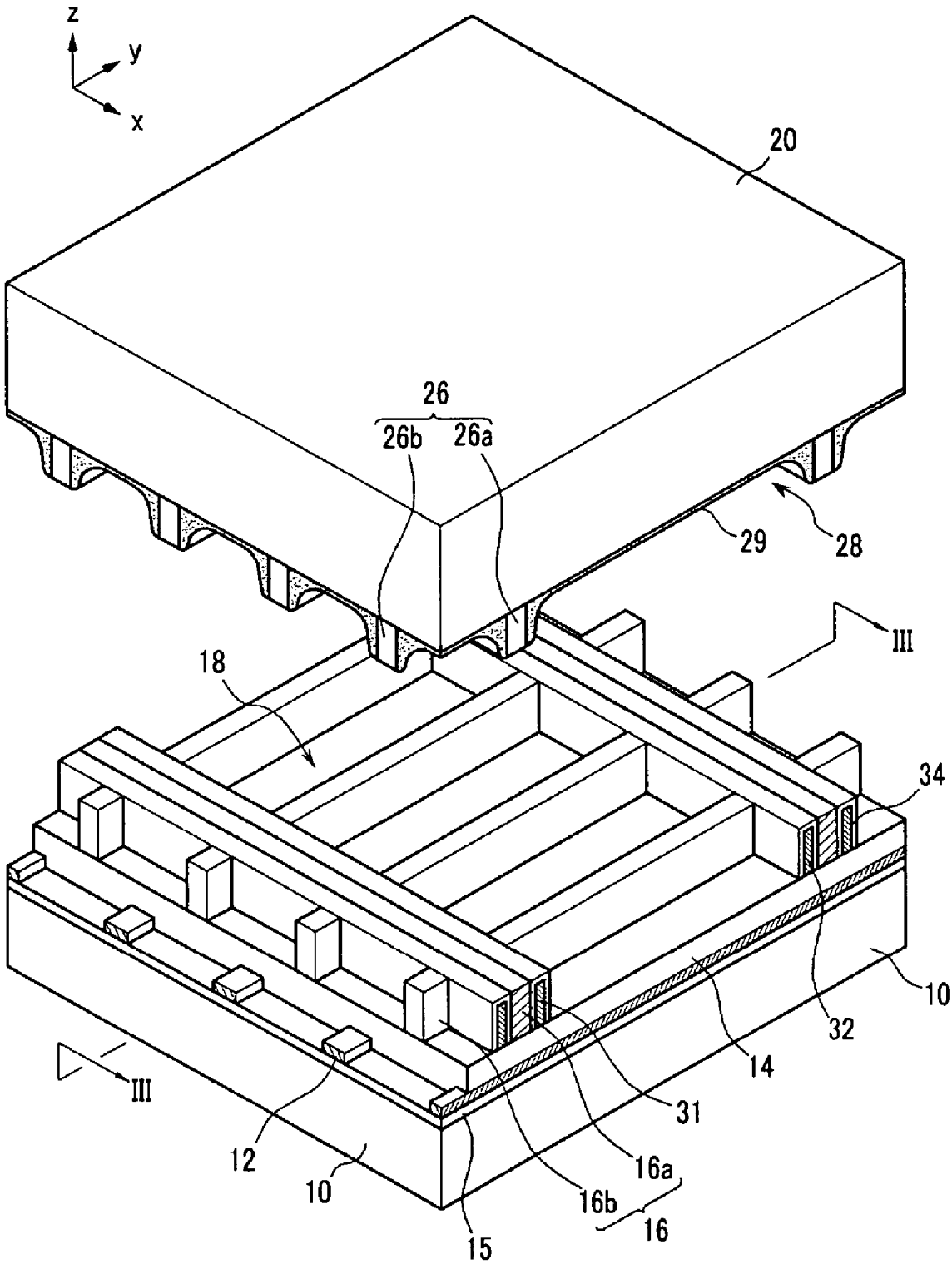
FIG. 1 is a partial exploded perspective view of a PDP according to a first exemplary embodiment of the present invention.

Hereinafter, with reference to the accompanying drawings, embodiments of the present invention will be described in order for those skilled in the art to be able to implement it. As those skilled in the art would realize, the described embodiments may be modified in various different ways, all without departing from the spirit or scope of the present invention. Wherever possible, the same reference numbers will be used throughout the drawing(s) to refer to the same or like parts.

Figure 2:
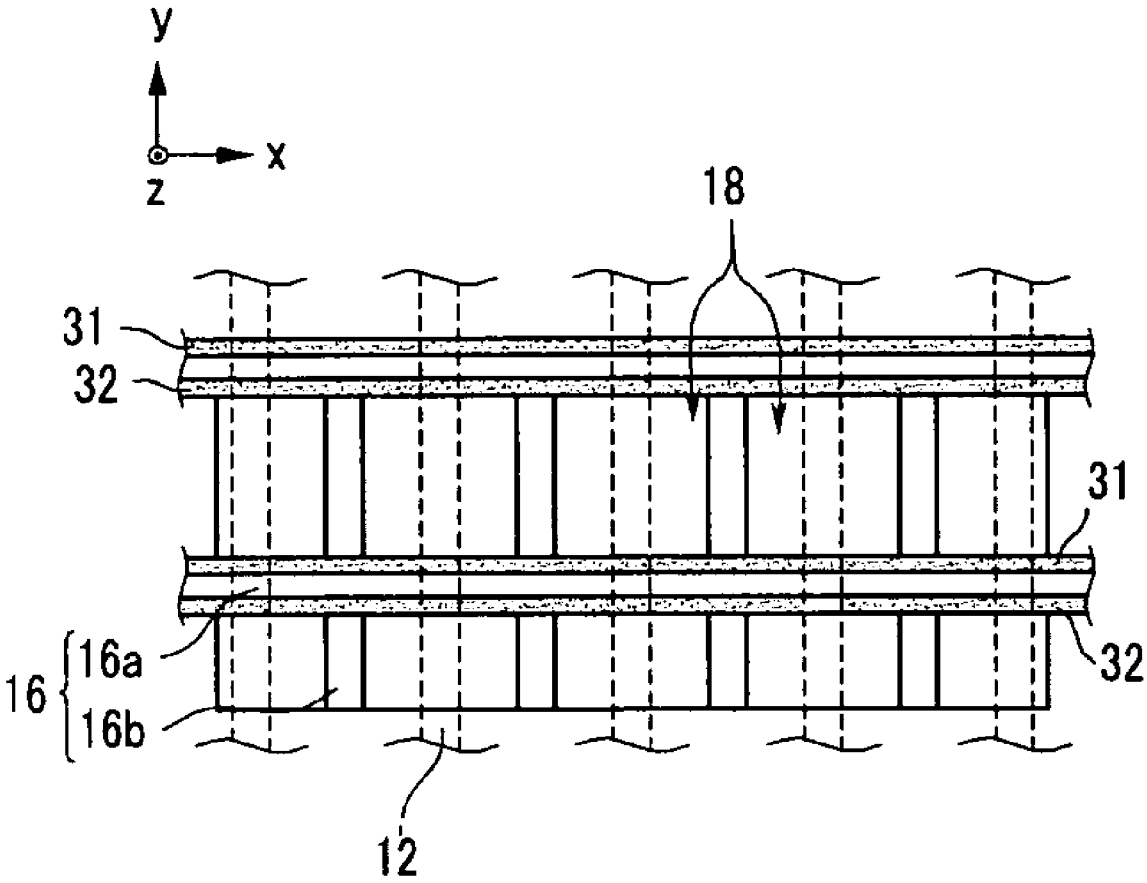
FIG. 2 is a schematic partial top plan view showing the structure of electrodes and discharge cells in the PDP shown in FIG. 1.
Figure 3:
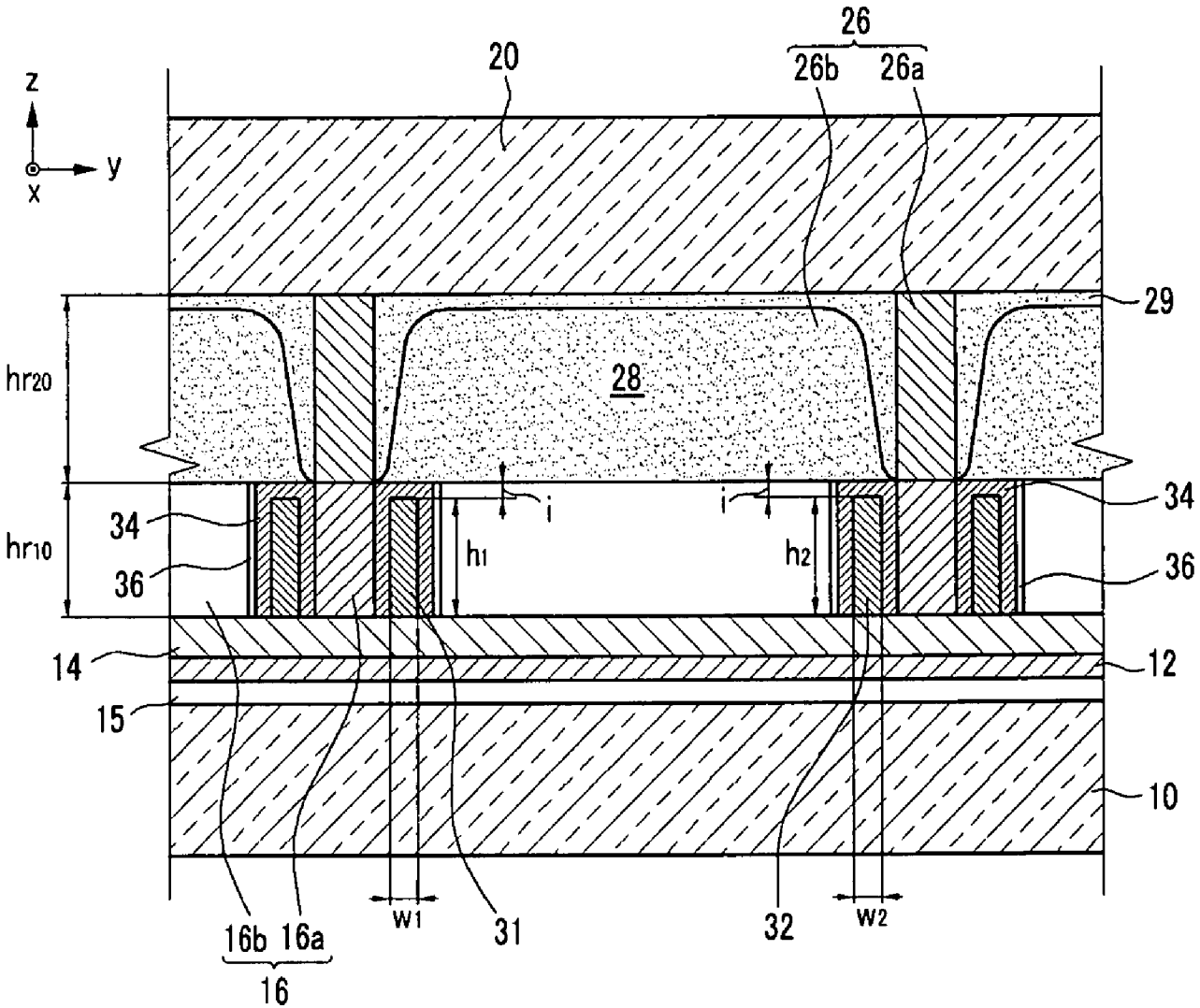
FIG. 3 is a partial sectional view of an assembled PDP, taken along the line III-III of FIG. 1.

Referring to FIGS. 1-3, a PDP according to an exemplary embodiment of the present invention includes a rear substrate 10 and a front substrate 20, facing each other and having a space therebetween. Barrier ribs 16 and 26 are formed between the rear substrate 10 and the front substrate 20, and a plurality of discharge cells 18 and 28 forming discharge spaces are partitioned by the barrier ribs 16 and 26 between the two substrates 10 and 20.

A phosphor layer 29 is formed in the inner surface of the discharge space, and it emits visible light by collision with vacuum ultraviolet (VUV) rays. Additionally, a discharge gas to generate gas discharge (for example a gas mixture including xenon (Xe), neon (Ne), and the like) is disposed inside the discharge space.

A plurality of address electrodes 12, extending in a y-axis direction as shown in FIGS. 1-3, are formed on the inner surface of the rear substrate 10. The address electrodes 12 are covered by a dielectric layer 14 which covers substantially the entire inner surface of the rear substrate 10. The address electrodes 12 are disposed in parallel with and spaced apart from each other at a distance corresponding to an x-axis directional size of the discharge cells 18 and 28 in the x-axis direction.

The barrier ribs 16 and 26 include a rear-plate barrier rib 16 and a front-plate barrier rib 26 between the rear substrate 10 and the front substrate 20. The rear-plate barrier rib 16 adjacent to the rear substrate 10 protrudes towards the front substrate 20, and the front-plate barrier rib 26 adjacent to the front substrate 20 protrudes towards the rear substrate 10.

The rear-plate barrier rib 16 is formed on a dielectric layer 14 which is formed on the rear substrate 10. The rear-plate barrier rib 16 includes first barrier rib members 16*a* disposed in the x-axis direction crossing the address electrodes 12, and second barrier rib members 16*b* crossing the first barrier rib members 16*a* and disposed in the direction parallel to the address electrodes 12. Each discharge cell 18 is partitioned as an individual discharge space by the first barrier rib members 16*a* and the second barrier rib members 16*b*.

The front-plate barrier rib 26 includes third barrier rib members 26*a*, corresponding to the first barrier rib members 16*a*, and fourth barrier rib members 26*b*, corresponding to the second barrier rib members 16*b*. Accordingly, the third barrier rib members 26*a* and the fourth barrier rib members 26*b* are formed in directions crossing each other that correspond to those of the first barrier rib members 16*a* and the second barrier rib members 16*b*. The second discharge cells 28 are formed on the front substrate 20 corresponding to the first discharge cells 18 of the rear substrate 10. The discharge spaces are formed by the first and second discharge cells 18 and 28.

Between the rear substrate 10 and the front substrate 20, a sustain electrode 31 and a scan electrode 32 are formed respectively extending along the x-axis direction parallel to the first barrier rib members 16*a* that partition the first discharge cells 18. Additionally, each of the sustain electrode 31 and scan electrode 32 corresponds to the adjacent first barrier rib members 16*a* forming side walls of the first discharge cells 18, and are formed in the inner surface of the first barrier rib member 16*a* forming an inner side of the first discharge cell 18. Accordingly, the barrier ribs and electrodes may be formed more easily adjacent to each other than when the sustain electrodes 31 and the scan electrodes 32 are formed inside the barrier ribs.

The scan electrodes 32 and the address electrodes 12 crossing them are involved in discharge for an address period and play a role in selecting turn-on discharge cells 18 and 28. Additionally, the sustain electrodes 31 and the scan electrodes 32 are involved in discharge for a sustain period and play a role in displaying an image. However, each electrode may act in different ways according to a signal voltage applied thereto, and the present invention is not limited to the above description.

In some embodiments, outer surfaces of the sustain electrode 31 and scan electrode 32 may be surrounded by the dielectric layer 34. Accordingly, wall charges required for the address period and the sustain period are formed on the dielectric layer 34, and a required discharge voltage may be decreased.

Referring to FIG. 3, the height $h_{r20}$ of the front-plate barrier rib 26 can be greater than 50 μm, and the height $h_{r10}$ of the rear-plate barrier rib 16 may be smaller than the height $h_{r20}$ of the front-plate barrier rib 26, such as less than 50 μm. Additionally, cross-sectional lengths $h_1$,$h_2$ in the vertical direction of the sustain electrode 31 and the scan electrode 32 may be equal to each other and less than half of a sum of the height $h_{r10}$ of the rear-plate barrier rib 16 and the height $h_{r20}$ of the front-plate barrier rib 26, or $h_1,h_2<(h_{r10}+h_{r20})/2$. In one embodiment, the lengths $h_1$,$h_2$ in the vertical direction of the sustain electrode 31 and scan electrode 32 may be equal to or less than 50 μm, because the sustain electrode 31 and the scan electrode 32 are formed on side surfaces of the first barrier rib member 16*a* of the rear-plate barrier rib 16.

Additionally, the height $h_{r10}$ of the rear-plate barrier rib 16 may be equal to the sum of the vertical length $h_1$ of the sustain electrode 31 and the height i of the dielectric layer 34 surrounding the sustain electrode 31, or $h_{r10}=h_{1+i}$. The height $h_{r10}$ may additionally be equal to a sum of the vertical length $h_2$ of the scan electrode 32 and the height i of the dielectric layer 34 surrounding the scan electrode 32, or $h_{r10}=h_2+i$.

In the exemplary embodiment shown in FIGS. 1-3, the sustain electrodes 31 and the scan electrodes 32 are formed corresponding to the rear-plate barrier rib 16, and the phosphor layer 29 is formed on the front substrate 20. Accordingly, as described above, the relationship between the size of the rear-plate barrier rib 16 and that of the front-plate barrier rib 26 as well as the relationship of the sizes of the sustain electrode 31 and the scan electrodes 32 to the size of the rear-plate barrier rib 16 may decrease or prevent deterioration of the phosphor layer 29 caused by the sustain discharge.

The cross-sectional lengths $h_1$, $h_2$ of the sustain electrode 31 and the scan electrode 32 in the direction perpendicular to the surfaces of the substrates 10 and 20 (z-axis direction, as shown in FIGS. 1-3) may be greater than the lengths $w_1$, $w_2$ in a direction parallel to the surfaces of the substrates 10 and 20 (y-axis direction). Accordingly, opposing discharges between the sustain electrode 31 and the scan electrode 32 can be induced more easily, and thereby luminescence efficiency may be increased.

Additionally, as shown in FIG. 3, the length $w_1$ in the parallel direction of the sustain electrode 31 may be equal to the length $w_2$ in the parallel direction of the scan electrode 32, and the length $h_1$ in the vertical direction of the sustain electrode 31 may be equal to the length $h_2$ in the vertical direction of the scan electrode 32. Accordingly, an opposing discharge between the sustain electrode 31 and the scan electrode 32 is effectively generated symmetrically to each electrode.

A Magnesium Oxide (MgO) protective layer 36 may be formed on the surface of the dielectric layer 34 surrounding the sustain electrode 31 and scan electrode 32. In particular, the MgO protective layer 36 may be formed on a portion of the surface of the dielectric layer 34 that is exposed to a plasma discharge generated in the discharge space of the discharge cells 18. In the embodiment shown, the sustain electrodes 31 and scan electrodes 32 are not formed on the front substrate 20. Accordingly, the MgO protective layer 36 applied to the dielectric layer 34 covering the sustain electrode 31 and scan electrode 32 may be formed of MgO having a characteristic of non-transmittance of visible light. MgO that is incapable of transmitting visible light has a far higher secondary electron emission coefficient than MgO capable of transmitting visible light, and thereby the voltage required for discharge firing may be further decreased.

The sustain electrode 31 and scan electrode 32 having a dielectric layer 34 and a MgO protective layer 36 are disposed parallel to the first and third barrier rib members 16*a* and 26*a*, and are disposed crossing the second barrier rib member 16*b*.

Additionally, the sustain electrodes 31 and the scan electrodes 32 may be formed of a metal having excellent electrical conductivity.

A light-reflecting dielectric layer 15 may be formed between the rear substrate 10 and the address electrode 12. The light-reflecting dielectric layer 15 may be formed from a dielectric material in a thin film or paste state. Additionally, the light-reflecting dielectric layer 15 may be formed of a material that effectively reflects visible light or vacuum ultraviolet (VUV) rays. Visible light generated by the first discharge cell 18 is transmitted through the front substrate 20, and thereby the light-reflecting dielectric layer 15 does not disturb the transmittance of the visible light. Accordingly, the light-reflecting dielectric layer 15 may be formed of a dielectric material having various colors including a white or black color.

The phosphor layer 29 is formed on the inner surfaces of the third barrier rib members 26*a* and fourth barrier rib members 26*b* on the front substrate 20, as well as on the inner surface of the front substrate 20 partitioned by the third barrier rib members 26*a* and fourth barrier rib members 26*b*. That is, the phosphor layer 29 is formed in the second discharge cells 28. A dielectric material is applied on the front substrate 20, a front-plate barrier rib 26 is formed, and subsequently the phosphor layer 29 may be formed on the dielectric layer. Alternatively, the phosphor layer may be formed by applying the phosphor after forming the front-plate barrier rib 26 on the front substrate 20, without applying the dielectric material onto the front substrate 20. Alternatively, the phosphor may be applied onto the front substrate 20 after etching the front substrate 20 according to the shape of the first discharge cells 18. In this case, the front-plate barrier rib 26 is formed of the same material as that of the front substrate 20.

In the exemplary embodiment shown in FIGS. 1-3, VUV rays are generated by discharges occurring in the first discharge cells 18. The phosphor layer 29 is then excited by the VUV rays radiated toward the front substrate 20, and thereby visible light is generated. Accordingly, in order to increase transmittance of visible light, the thickness of the phosphor layer 29 may be formed thinner than that of a phosphor layer formed on a rear substrate in a conventional PDP. In the case of the conventional PDP, a phosphor layer is formed with a thickness of 30 μm. However, the phosphor layer 29 may be formed with a thickness less than 10 μm in the present exemplary embodiment. By forming a thin phosphor layer 29, loss of VUV rays may be minimized and luminescence efficiency may be improved.

As described above, a PDP is fabricated by: forming rear-plate barrier ribs 16, sustain electrodes 31, and scan electrodes 32 on a rear substrate 10; forming front-plate barrier ribs 26 and phosphor layers 29 on a front substrate 20; and encapsulating together the rear substrate 10 and the front substrate 20.

Figure 4:
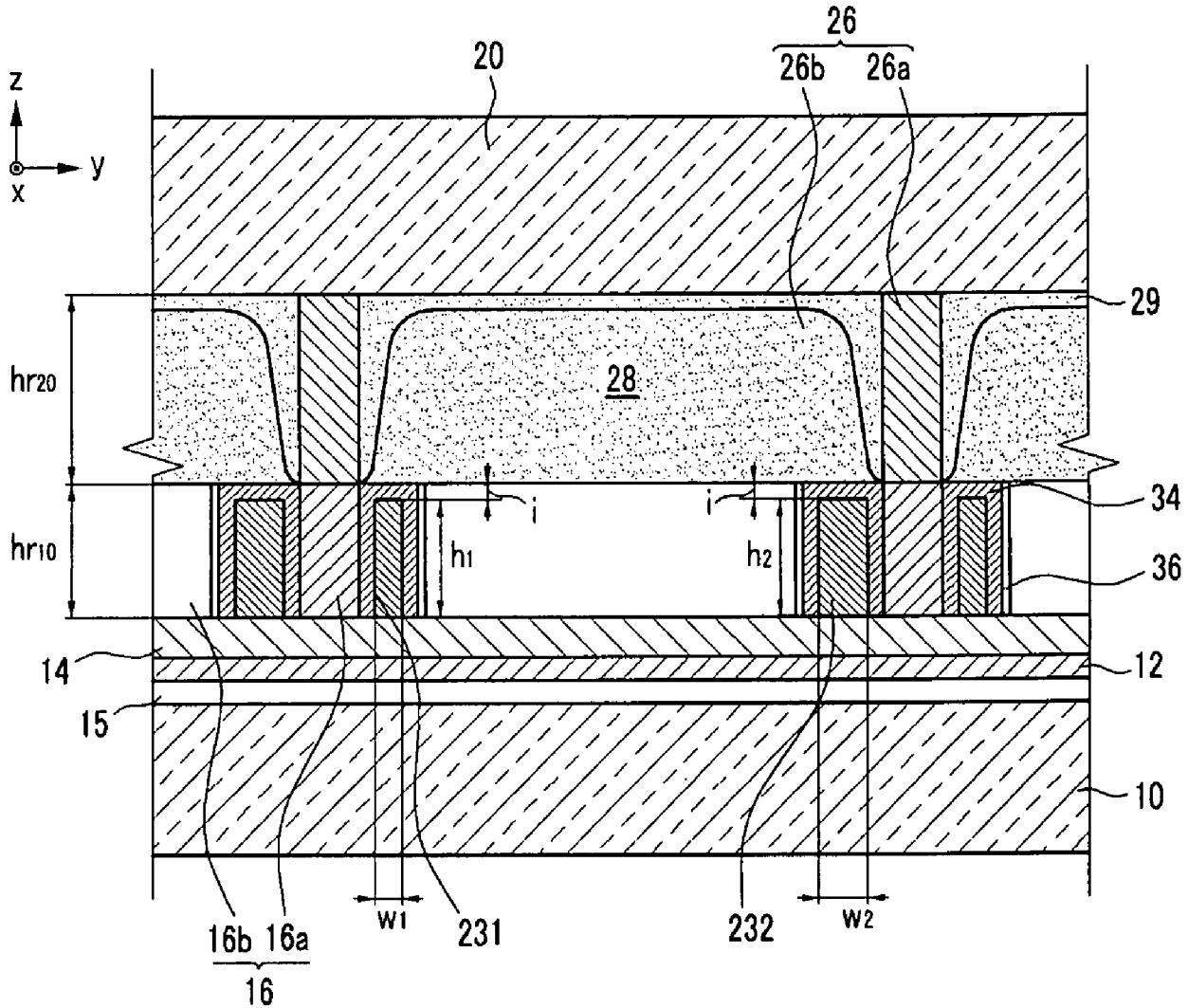
FIG. 4 is a partial sectional view of a PDP according to a second exemplary embodiment of the present invention.

Referring to FIG. 4, a scan electrode 232 according to a second exemplary embodiment of the present invention is formed as a structure different from that of the scan electrode 32 in the embodiments discussed above. As discussed above, the cross-sectional length $h_1$ of a sustain electrode 231 in the direction perpendicular to the substrates 10 and 20 (z-axis direction) is greater than the length $w_1$ in the direction parallel to the substrates 10 and 20 (y-axis direction). However, the cross-sectional length $w_2$ Of the scan electrode 232 in the y-axis direction is greater than the length $w_1$ of the sustain electrode 231 in the y-axis direction. The length $h_2$ of the scan electrode 232 in the vertical direction is equal to the length $h_1$ of the sustain electrode 231 in the vertical direction. A facing area of the scan electrode 232 and the address electrode 12 is thereby increased and address discharge may be generated more easily. The remaining configuration and elements of this embodiment are similar to that described above, and will therefore not be described in more detail.

Figure 5:
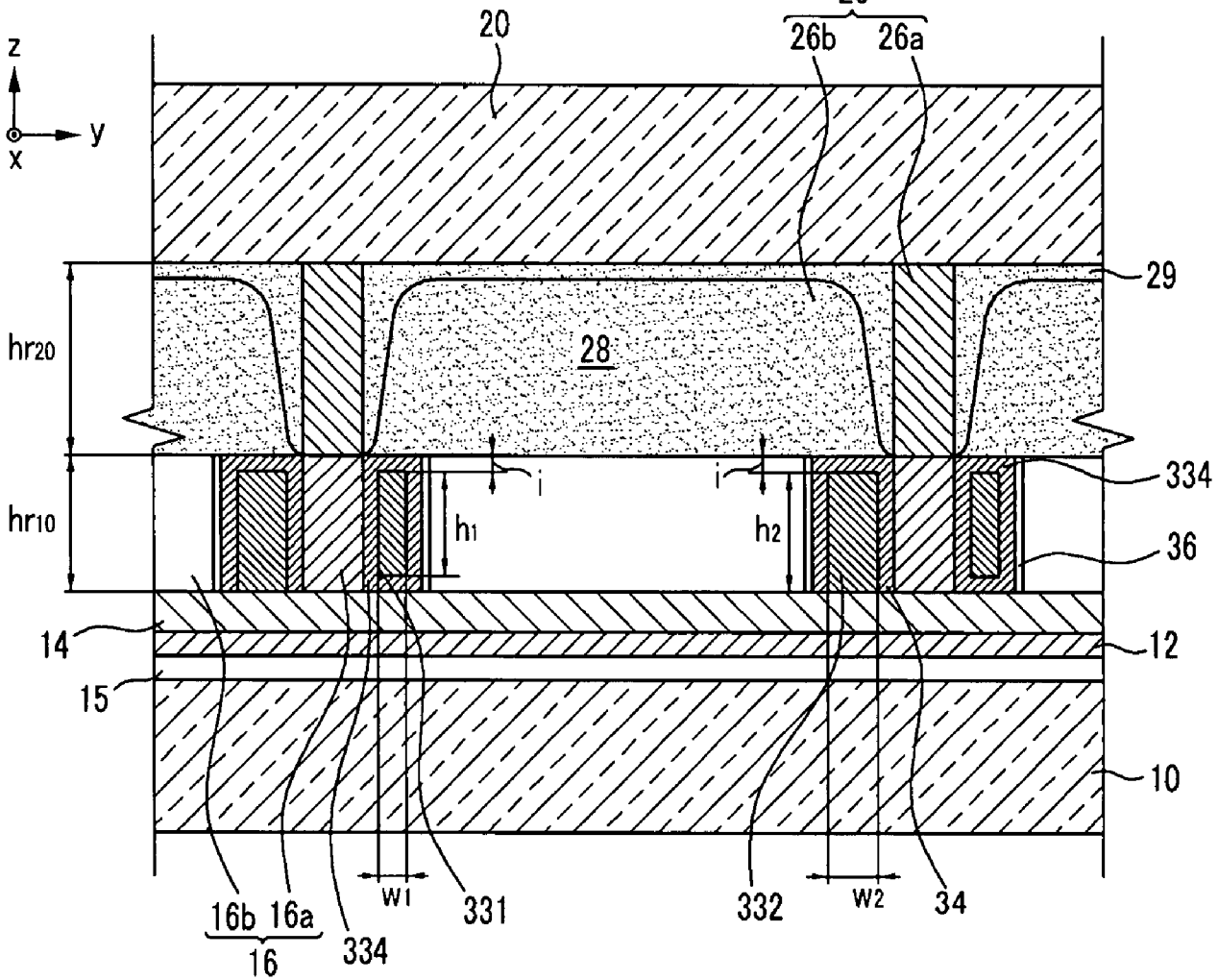
FIG. 5 is a partial sectional view of a PDP according to a third exemplary embodiment of the present invention.

Referring to FIG. 5, a sustain electrode 331 according to a third embodiment is surrounded by a dielectric layer 334 on two surfaces (upper and lower surfaces along the z-axis) in a direction parallel to the substrates 10 and 20 and two surfaces (left and right surfaces corresponding to the y-axis) in a direction perpendicular to the substrates 10 and 20. Further, like the previously described embodiments, a scan electrode 332 is surrounded by a dielectric layer 34 on a surface of the scan electrode 332 parallel to the front substrate 20 and two surfaces thereof vertical to the front substrate 20. Accordingly, the sustain electrode 331 is spaced apart from the address electrode 12 by a distance equal to the thicknesses of the dielectric layer 334, and thereby wrong address discharges between the sustain electrode 331 and the address electrode 12 may be prevented or reduced. The remaining configuration and elements of this embodiment are similar to that described above, and will therefore not be described in more detail.

As described above, a PDP according to the embodiments of the present invention includes barrier ribs on a rear substrate partitioning first discharge cells, and sustain electrodes and scan electrodes are formed adjacent to the barrier ribs. Additionally, the second barrier ribs partitioning second discharge cells are formed on a front substrate, and phosphor layers are formed in the second discharge cells. By this structure, opposing discharge is performed, and visible light generated by a sustain discharge is transmitted through the front substrate, thereby improving luminescence efficiency. Additionally, a PDP may be more easily fabricated by encapsulating the two substrates, since the electrodes and the phosphor layers are each formed on different substrates.

Additionally, according to the described embodiments of the present invention, barrier ribs and electrodes may be fabricated more easily by forming the sustain electrodes and the scan electrodes on a side surface of the barrier rib. Additionally, by forming a light-reflecting dielectric layer between the rear substrate and the address electrode, visible light and VUV rays in the discharge cells are reflected toward the front substrate, thereby improving luminescence efficiency.

While this invention has been described in connection with what is presently considered to be exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A plasma display panel including:

a first substrate;

a second substrate facing the first substrate;

an address electrode formed on the first substrate and extending in a first direction;

a first barrier rib partitioning a plurality of first discharge cells on the first substrate, the first barrier rib including first barrier rib members disposed in a second direction crossing the first direction and second barrier rib members disposed in the first direction;

a first electrode and a second electrode extended along the second direction and disposed in the first discharge cells between the first substrate and the second substrate bordering each side wall of, the first barrier rib members;

a second barrier rib on the second substrate partitioning second discharge cells corresponding to the first discharge cells, and including third barrier rib members, corresponding to the first barrier rib members and protruding towards the first substrate, and fourth barrier rib members, corresponding to the second barrier rib members and protruding towards the first substrate; and a phosphor layer formed in each of the second discharge cells, wherein the first electrode has a first electrode height and a first electrode width, the second electrode has a second electrode height and a second electrode width, the first barrier rib has a first barrier rib height and a first barrier rib width, and the second barrier rib has a second barrier rib height and a second barrier rib width, the first electrode height, the second electrode height, the first barrier rib height, and the second barrier rib height being measured in a third direction perpendicular to both the first direction and the second direction, and the first electrode width, the second electrode width, the first barrier rib width, and the second barrier rib width being measured in the first direction or the second direction.

2. The plasma display panel of claim 1, wherein outer surfaces of the first electrode and the second electrode are surrounded by a dielectric layer, the dielectric layer having a first electrode dielectric layer height and a second electrode dielectric layer height measured along the third direction.

3. The plasma display panel of claim 1, wherein the first electrode height is less than half of a sum of the first barrier rib height and the second barrier rib height.

4. The plasma display panel of claim 3, wherein the second electrode height is less than half of the sum of the first barrier rib height and the second barrier rib height.

5. The plasma display panel of claim 4, wherein the first electrode height and the second electrode height are less than or equal to 50 μn.

6. The plasma display panel of claim 1, wherein the first barrier rib height is less than the second barrier rib height.

7. The plasma display panel of claim 2 wherein the first barrier rib height is equal to a sum of the first electrode height and the first electrode dielectric layer height.

8. The plasma display panel of claim 7, wherein the first barrier rib height is equal to a sum of the second electrode height and the second electrode dielectric layer height.

9. The plasma display panel of claim 1, wherein the first electrode height is greater than the first electrode width.

10. The plasma display panel of claim 9, wherein the second electrode height is greater than the second electrode width.

11. The plasma display panel of claim 10, wherein the first electrode width is equal to the second electrode width.

12. The plasma display panel of claim 11, wherein the first electrode height is equal to the second electrode height.

13. The plasma display panel of claim 1, wherein the first electrode height is greater than the first electrode width.

14. The plasma display panel of claim 13, wherein the second electrode width is greater than the first electrode width and the second electrode height is equal to the first electrode height.

15. The plasma display panel of claim 14, wherein:

two surfaces of the first electrode along the first direction or the second direction and two surfaces of the first electrode in the third direction are surrounded by a first dielectric layer; and one surface of the second electrode along the first direction or the second direction and two surfaces of the second electrode along the third direction are surrounded by a second dielectric layer.

16. The plasma display panel of claim 1, wherein a light-reflecting dielectric layer is disposed between the first substrate and the address electrode.

17. The plasma display panel of claim 16, wherein the light-reflecting dielectric layer is formed from a dielectric material in a thin film state.

18. The plasma display panel of claim 16, wherein the light-reflecting dielectric layer is formed from a dielectric material in a paste state.

19. The plasma display panel of claim 1, wherein the phosphor layer is formed on the inner surfaces of the third barrier rib members and the fourth barrier rib members partitioning the second discharge cells, and on the inner surface of the second substrate partitioned by the third barrier rib members and the fourth barrier rib members.

20. The plasma display panel of claim 19, wherein the phosphor layer has a thickness of less than 10 μm.

21. The plasma display panel of claim 2, further comprising a magnesium oxide protective layer formed on a surface of the dielectric layer.

* * * * *